US006290597B1

(12) United States Patent
Jones et al.

(10) Patent No.: US 6,290,597 B1
(45) Date of Patent: Sep. 18, 2001

(54) AIR DIFFUSER WITH ADJUSTABLE PATTERN CONTROLLER BLADES

(75) Inventors: Gordon G. Jones; Gerald Cook, both of Tucson, AZ (US)

(73) Assignee: Air System Components L.P., Dayton, OH (US)

( * ) Notice: Subject to any disclaimer, the term of this patent is extended or adjusted under 35 U.S.C. 154(b) by 0 days.

(21) Appl. No.: 09/484,890

(22) Filed: Jan. 18, 2000

(51) Int. Cl.[7] ..... F24F 7/00
(52) U.S. Cl. ..... 454/303; 454/304
(58) Field of Search ..... 454/303, 292, 454/301, 304

(56) References Cited

U.S. PATENT DOCUMENTS

| | | |
|---|---|---|
| 2,221,001 | 11/1940 | Lucius . |
| 3,177,795 | 4/1965 | Schutt . |
| 3,177,796 | 4/1965 | Lee et al. . |
| 3,266,408 | 8/1966 | Palmquist . |
| 3,276,348 | 10/1966 | Kennedy . |
| 3,319,559 | 5/1967 | Raider et al. . |
| 3,406,623 | 10/1968 | Lambert . |
| 3,601,033 | 8/1971 | Lambert . |
| 3,760,709 | 9/1973 | Rachlin et al. . |
| 3,811,369 | 5/1974 | Ruegg . |
| 3,828,508 | 8/1974 | Moeller . |
| 3,848,799 | 11/1974 | Day . |
| 4,316,407 | 2/1982 | Lambert . |
| 4,491,062 | 1/1985 | Sylvester et al. . |
| 4,811,575 | 3/1989 | Currier et al. . |
| 4,815,362 | 3/1989 | Ishizuka et al. . |
| 4,851,066 | 7/1989 | Currier et al. . |
| 4,869,157 | 9/1989 | Hungerford . |
| 5,001,967 | 3/1991 | Hungerford . |
| 5,107,687 | 4/1992 | Candeloro . |
| 5,107,755 | 4/1992 | Leban et al. . |
| 5,215,284 | 6/1993 | Hungerford . |
| 5,219,312 | 6/1993 | Smith . |
| 5,433,662 | 7/1995 | Hungerford . |
| 5,447,471 | 9/1995 | McDermott . |
| 5,462,484 | 10/1995 | Jung et al. . |
| 5,788,572 | 8/1998 | Felsen . |
| 5,871,334 | 2/1999 | Suzuki et al. . |

FOREIGN PATENT DOCUMENTS

| | | |
|---|---|---|
| 843290 | 7/1949 | (DE) . |

*Primary Examiner*—Jiping Lu
(74) *Attorney, Agent, or Firm*—Shughart Thomson & Kilroy P.C.; Malcolm A. Litman

(57) ABSTRACT

A slot diffuser includes a pair of elongate and parallel side walls spaced by pairs of bridges. The bridges include feet that slide along receivers in the side walls such that the bridges can be positioned at any location therealong and provide support to the bridges and stability to the diffuser. The bridges include slots that extend between the side rails and that receive ends of air flow control blades. The air flow control blades include an elongate planar portion supported by rods extending outwardly on either side of the planar portions to support the blades in the slots. At a lower end of each planar portion opposite the rods is a foot that extends perpendicularly outward therefrom. Each side rail includes an inwardly projecting flange that is sized and positioned to slidably receive the foot of an associated blade such that the blade may be manually moved both within the slot and along the flange to properly position the blade during the installation or subsequent modification. The blades are easily and rapidly removed without requiring full disassembly of the diffuser or removal of the diffuser from its installed location.

7 Claims, 2 Drawing Sheets

AIR DIFFUSER WITH ADJUSTABLE PATTERN CONTROLLER BLADES

BACKGROUND OF THE INVENTION

The present invention is directed to slot diffusers or air bars that control air flow from a ventilation system into a room and, in particular, to adjustable controller blades for controlling the flow of a jet stream of air into a room.

Slot type air diffusers are used in many different environments from controlling air flow from a heating and cooling ventilation system into a room. It is sometimes necessary to provide an air flow that is a "jet" of air from the diffuser and that flows generally straight through the diffuser so as to exit generally perpendicularly into the room relative to the face of the diffuser. Such streams of air provide substantial heating or cooling to a directed point in the room that is generally positioned directly in front of the diffuser.

When utilizing such diffusers, it is necessary to initially set the correct flow of air through the diffuser. For this purpose, control blades are provided that control the volume of air passing through the diffuser into the room and may also have some degree of control over the direction that the air flows. However, it is highly desirable to be able to fine-tune the air stream emanating from a diffuser of this type when the device is initially installed and to also be able to later adjust the air flow, should conditions within the room change. Consequently, it is desirable to have control blades which allow a user to very quickly and easily to modify the position of the blades within the diffuser.

Furthermore, it is desirable to have blades that resist movement caused by air passing through the diffuser. Movement of the blades produces noise, and reducing such movement reduces the noise produced by the ventilation system. Also, it is desirable to have blades that can be easily removed for repair or change-out to a different blade system should the requirement of the installation change substantially or should the diffuser be moved to a different location.

SUMMARY OF THE INVENTION

An air diffuser includes a pair of parallel and spaced side rails joined by spaced bridges. Each of the bridges includes a slot that faces toward a companion bridge. Received in the bridge slots are a pair of air flow control blades. The air flow control blades include an elongate planar portion that extends between the bridges and a rod joined to one side of the planar portions. The rod extends beyond the planar portion to provide slot following pegs that are received by the bridge slots so as to allow the blades to slide along the bridge slots due to manual pressure to adjust the lateral position of the blades. The planar portion of the blade hangs vertically beneath the rod so as to be generally parallel to flow of air through the diffuser.

Attached to the blade opposite the rod is a flange or foot that extends outward perpendicular to the planar portion. The side rails of the diffuser also preferably include a side wall ending in a lower flange or lip that extends inwardly. Preferably, the inward facing surface of the side rail flange is sized and positioned such that the foot of a respective control blade rests on and slides along the surface as the blade is adjusted in position so as to stabilize the position of the blade against movement of air through the diffuser.

Preferably, the bridges are slidably supported by the side rails by feet received in side rail receivers. The blades may be rotated 90° for purposes of removal such that the planar portion of the blade is parallel with the slot and such that the rod is positioned to align with an opening in the rear of the slot. In this position the blade may be biased toward one or other bridges so that it moves toward the slot and the bridge may also move slightly as it is slidable along the rail due to pressure being applied to it. In this manner the blade moves sufficiently away from an opposed bridge to allow the blade to be removed for repair or replacement by a different type of blade.

OBJECTS AND ADVANTAGES OF THE INVENTION

Therefore, the principle objects of the present invention are: to provide a slot air diffuser that provides a jet air flow from a heating and cooling ventilation system that includes vertically aligned air flow control blades that are laterally positionable upon installation or upon subsequent modification by simple manual manipulation to provide for different flow characteristics such as volume control and directional control; to provide such a diffuser wherein the control blades include a planar section joined to a rod extending beyond the planar section to form slot following pegs from which the planar section hangs; to provide such a diffuser wherein opposite ends of the control blades are slidably received in slots that allow the blades to be moved laterally; to provide such a diffuser wherein the control blades include a lower flange or foot for stabilizing the control blade against movement in the air stream passing through the diffuser; to provide such a diffuser wherein side rails are provided that support bridges and which include a lower flange that is sized and positioned to receive the foot of the control blade and to allow the control blade to slide therealong as the control blade is adjusted; to provide such a diffuser wherein the control blade can be readily removed for repair or replacement by other blades without disassembly of the entire diffuser and without removing the diffuser from surrounding structure; and to provide such a diffuser which is relatively easy to construct, simple to maintain, inexpensive to produce and especially well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE ILLUSTRATED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figures 1, 2, 3, 4:
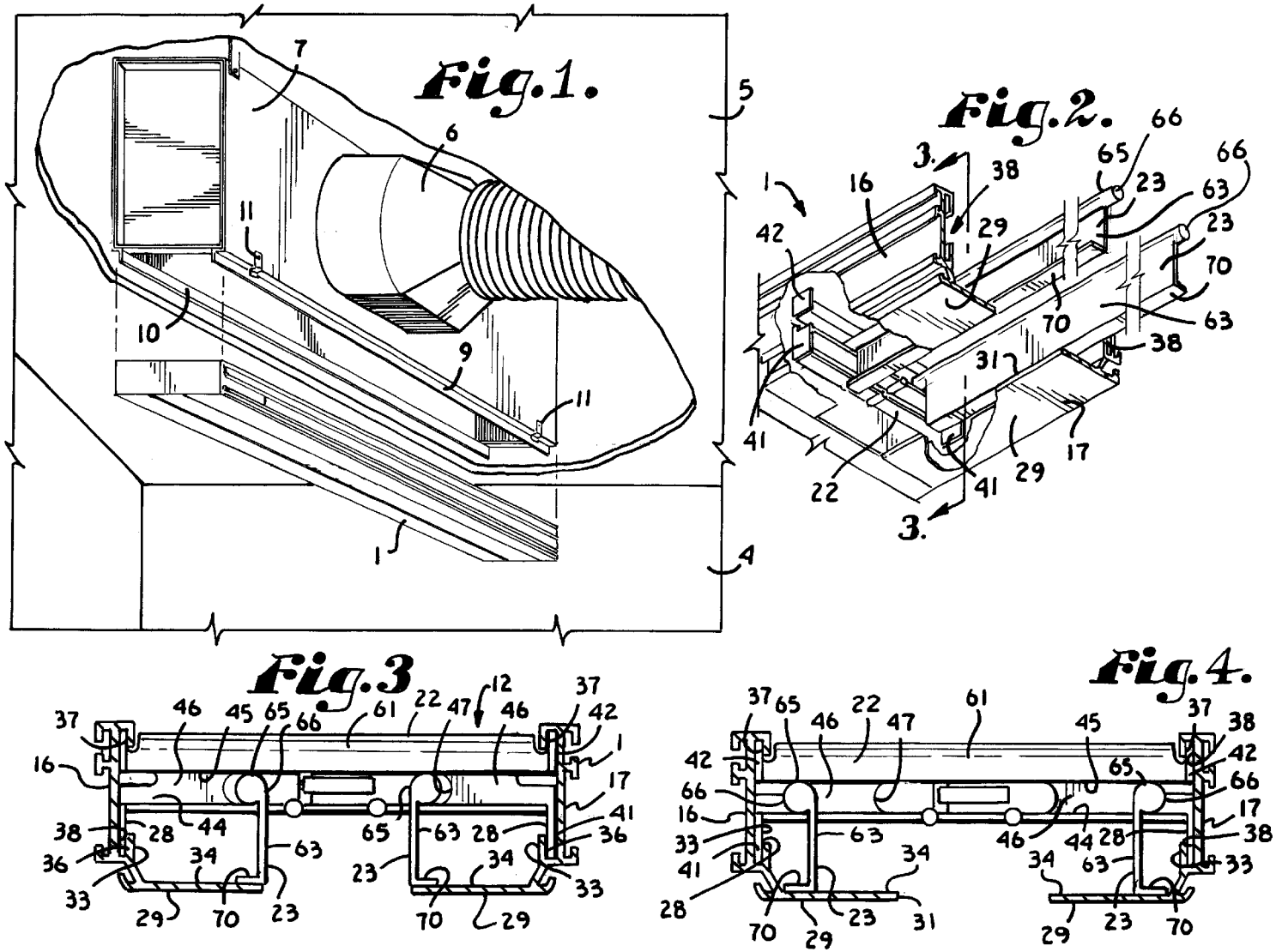
FIG. 1 is a perspective view of a slot air diffuser in accordance with the present invention shown just prior to final assembly with a plenum of a heating and cooling ventilation system that is mounted in a ceiling of a room, with portions of the ceiling broken away to show detail thereof.
FIG. 2 is a fragmentary and perspective view of the diffuser from below, illustrating side rails, a bridge and a pair of control blades of the diffuser, with portions broken away to illustrate detail thereof.
FIG. 3 is a cross sectional view of the diffuser, taken along line 3—3 of FIG. 2, with the control blades positioned comparatively close to each other.
FIG. 4 is a cross sectional view of the diffuser similar to FIG. 3 except illustrating the control blades spaced comparatively further apart from one another.
Figure 5:
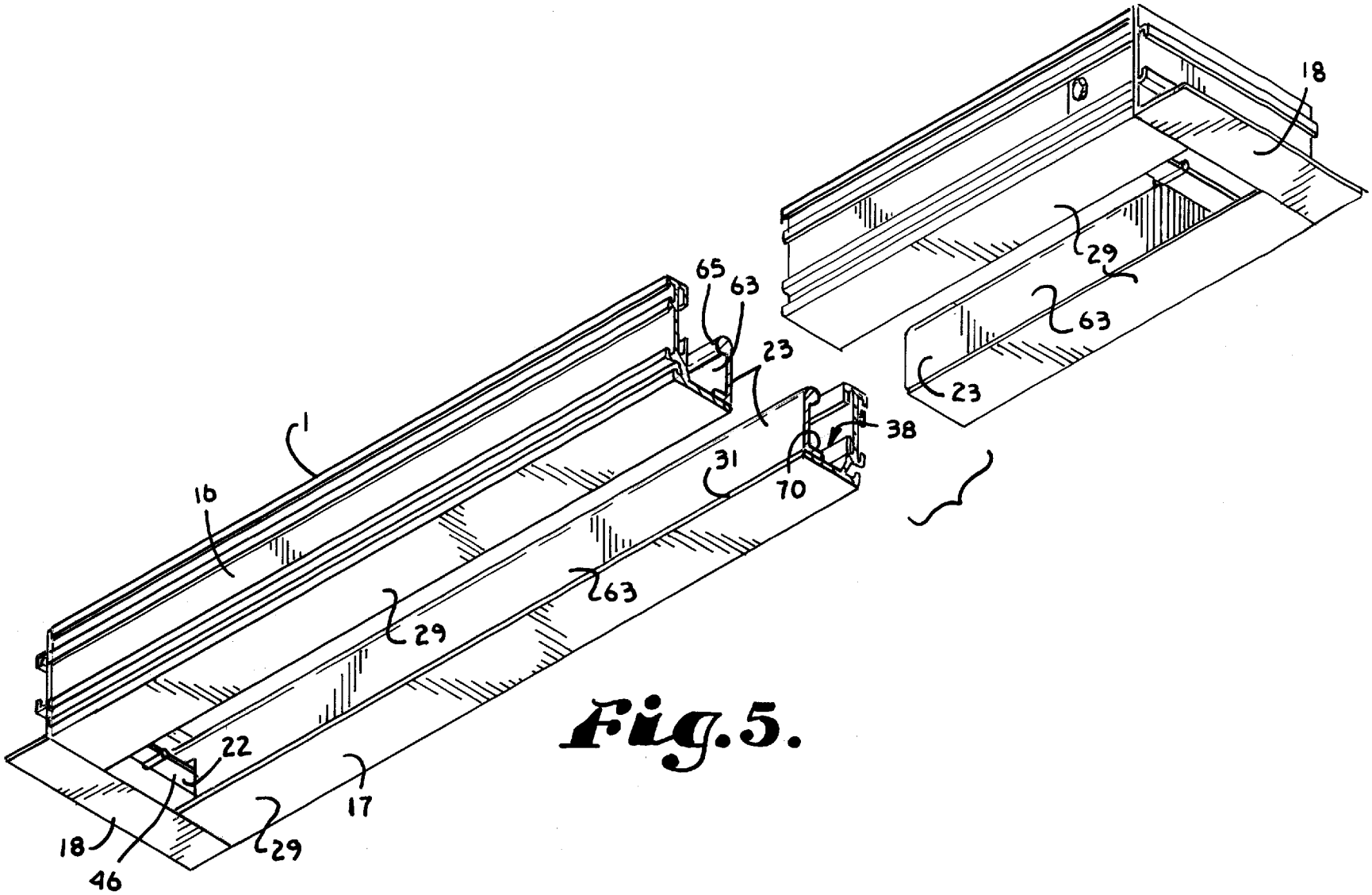
FIG. 5 is an enlarged and perspective view of the diffuser from below, with the blades shown in the same position as in FIG. 3.

The reference numeral 1 generally designates an air bar or slot air diffuser in accordance with the present invention. The diffuser 1 is shown in FIG. 1 just prior to final installation of the diffuser into a ceiling 5 of a room 4. The room has a air distribution plenum 6 located above the ceiling 5 that flow connects and opens into a boot 7. The boot 7 has flanges 9 and 10 that sealably mate with the diffuser 1 and a plurality of snaps or fasteners 11 which secure the diffuser 1 to the plenum 6 and, in particular, to the boot 7. In this manner, air being distributed by the plenum 6 is supplied to the top or plenum facing side 12 of the diffuser 1. The diffuser 1 includes a pair of side frame rails 16 and 17 joined at opposite ends thereof by end plates 18. The diffuser 1 also includes two pairs of bridges 22 and two pairs of air pattern controller blades 23.

The frame rails 16 and 17 are generally elongate and each has a side wall 28 and a bottom flange 29 that extend outwardly from the lower or outermost edge of each side wall 28 in a facing relationship to one another, but spaced so as to form a slot 31 therebetween. Each side wall 28 has an interior surface 33 such that the surfaces 33 of opposed side walls 28 facing each other. Likewise each bottom flange 29 has an inward facing or interior surface 34 that is generally perpendicular to the flow of air through the diffuser 1. Each side wall 28 also includes upper and lower facing flanges 36 and 37 that cooperate to form a receiver 38 within which portions of the bridges 22 are received in a manner that will be described later. Each receiver 38 extends longitudinally along the side rails to allow the bridges 22 to be placed at any location therealong.

Each of the bridges 22 is sized and shaped to extend between a pair of opposed side rails 16 and 17. Each of the bridges 22 have a pair of feet 41 and 42 that extend in opposite directions and are sized and shaped to be slidably received in the receivers 38. The bridges 22 are thus supported by the side rails 16 and 17, but are also slidable in the receivers 38 during assembly and during certain modifications of the diffuser 1. Each bridge 22 has a lower wall 44 and an upper wall 45 that extend between the feet 41 and 42 on opposite sides of the bridge 22, are parallel to one another and are spaced by a rear wall 46. For each bridge 22 the lower wall 44, upper wall 45 and rear wall 46 form a blade receiving slot 48 that operably and slidably receives the blades 23. The rear wall 46 also has a central aperture 47 therein.

Each bridge 22 has an upper curved arcuate surface forming a cover 61 that is rounded with a radius that allows smooth transition between the rear of the bridge (rear is into the page in FIG. 3 with respect to bridge 22 construction) with the front of the slot upper wall 45. The rounded surface of the cover 61 reduces drag of air across the bridge 22 and thus reduces noise created by air passing the associated bridge 22, as the air is less turbulent. Each of the blades 23 includes a generally planar and elongate portion 63 that is sized and shaped to extend between a pair of bridges 22, but is slightly less than the distances between the bridges in length so as to move freely therealong. Each of the blade planar portions 63 is joined along one edge thereof to a elongate rod 65 that is somewhat larger in diameter than the planar portion 63 and extends beyond the planar portion 63 at each end thereof so as to provide mounting pegs 66. The pegs 66 are sized and shaped to be received in the bridge slots 48, to slide easily within the slots 48 and to generally support the blades 23 in the bridges 22. The distance between the ends of opposite pegs 66 is greater than the distance between the bridges 22. Also attached along an edge of each planar portion 63 opposite an associated rod 65 is a flange or a foot 70. The foot 70 extends perpendicular to the blade planar portion 63 and, as discussed above, the blades 23 are sized and shaped such that the foot 70 thereof rest on and slides along an associated side wall flange surface 34, as each blade 23 is manually adjusted and positioned. Once in a selected and desired position, the blade foot 70 helps to stabilize the blade 23 and reduces the likelihood of the blade 23 moving or vibrating due to a flow of air past the blade 23.

In use, the diffuser 1 is assembled by placing two side rails 16 and 17 in spaced relation and sliding at least a pair, but in some cases, more than one pair of bridges 22 along the side rails 16 and 17 by placement of the bridge feet 41 and 42 into the side rail receivers 38. A pair of blades 23 is inserted so as to extend or be received in the bridge slots 48 and extend between a pair of bridges 22. The end plates 18 are then secured, and the diffuser 1 is attached to the plenum boot 7. The installer then manually positions the blades 23 by moving the blades 23 either closer to or further away from the side rails 16 and 17, as desired, to produce appropriate air flow. The closer the blades 23 to each other, the less volume of air exiting the diffuser 1, although the air stream will be more of a jet-type stream. As the blades 23 move further apart the velocity may reduce slightly and the blades 23 may also be used to control the direction of the air in a more diffuse or directional manner in cooperation with the side rail flange surfaces 34.

The blades 23 do not have to be evenly spaced from the side rails 16 and 17 and sometimes it is desirable to create a somewhat sideways flow of air by such a positioning. If it is desired, the blades 23 may be removed from the diffuser 1 while fully installed and without disassembly of the diffuser 1 by rotating the blades 90° such that the planar portion 63 aligns with the bridge slots 48 and the bridge rear wall aperture 47 aligns with the pegs 66. When so positioned, blades 23 are moved toward one of the bridges 22 until it no longer engages the opposite bridge and can be lowered by the technician. A replacement blade of the same type or of a different type can then be installed in the diffuser 1.

It is to be understood that while certain forms of the present invention have been illustrated and described herein, it is not to be limited to the specific forms or arrangement of parts described and shown.

What is claimed is:

1. A slot diffuser for distributing air flow to a room; said diffuser comprising:

a) a pair of spaced frame side rails;

b) a pair of spaced bridges joining said side rails, each of said bridges having a blade supporting wall; and c) a pair of air flow control blades mounted at opposite ends on said bridges respectively; each of said blades including an elongate planar portion and a rod; each of said rods extending beyond said planar portion so as to form outwardly projecting pegs having a circular cross section allowing rotation of said blades; said pegs being received on respective bridge supporting walls and being sized and shaped so as to allow a planar portion associated therewith to hang while said pegs along with associated blades, are laterally slidable along said bridge supporting wall so as to allow positioning of said blades in various laterally spaced orientations at a plurality of positions therealong and to thereby control flow of air through said diffuser.

2. The diffuser according to claim 1 wherein:

a) each of said blades also includes a flange joined to said planar portion parallel to and on an opposite side from said rod.

3. The diffuser according to claim 1 wherein:

a) each of said side rails includes a inwardly directed lower wall; each of said blades is sized and shaped such that the flange of said blade rests on and slides across a respective side rail lower wall as said blade is manually manipulated in said slots.

4. The diffuser according to claim 1 wherein:

a) said bridge blade supporting wall is a lower side of a slot.

5. The diffuser according to claim 4 wherein:

a) said bridges are spaced a first distance and said blade planar portions are shorter in length than said first distance; and b) a second distance between ends of opposite pegs is greater than said first distance.

6. The diffuser according to claim 5 wherein:

a) said slots are at least as wide as said blades such that said blades may be rotated ninety degrees and pushed from one end into a first slot so as to allow said blade to be released from an opposed second slot.

7. A slot diffuser for distributing air flow to a room; said diffuser comprising:

a) a pair of spaced frame side rails;

b) a pair of spaced bridges joining said side rails, each of said bridges having a blade supporting wall;

c) a pair of air flow control blades mounted at opposite ends on said bridges respectively; each of said blades including an elongate planar portion and a rod; each of said rods extending beyond said planar portion so as to form outwardly projecting pegs; said pegs being received on respective bridge supporting walls so as to allow a respective planar portion to hang while said pegs along with associated blades are laterally slidable along said bridge supporting wall so as to allow positioning of said blades in various laterally spaced orientations at a plurality of positions therealong and to thereby control flow of air through said diffuser; and d) each of said blades also includes a flange joined to said planar portion parallel to and on an opposite side from said rod.

* * * * *